US005111213A

United States Patent [19]

Jahoda et al.

[11] Patent Number: 5,111,213

[45] Date of Patent: May 5, 1992

[54] BROADBAND ANTENNA

[75] Inventors: Joseph R. Jahoda, Clifton; Steven D. Shergold, Bumpass, both of Va.

[73] Assignee: Astron Corporation, Herndon, Va.

[21] Appl. No.: 468,666

[22] Filed: Jan. 23, 1990

[51] Int. Cl.[5] ..... H01Q 11/02

[52] U.S. Cl. ..... 343/722; 343/739; 343/752; 343/818

[58] Field of Search ..... 343/705, 749, 722, 860, 343/740, 802, 790, 731, 737, 739, 752, 818, 865, 872, 895

[56] References Cited

U.S. PATENT DOCUMENTS 2,495,399 1/1950 Wheeler ..... 343/749
4,125,840 11/1978 Cassel ..... 343/722
4,423,423 12/1983 Bush ..... 343/803
4,511,898 4/1985 Bush ..... 343/736
4,536,768 8/1985 Dubowicz ..... 343/739

OTHER PUBLICATIONS

L. A. Moxon, *HF Antennas for All Locations*, Radio Society of Great Britain, pp. 198–199.

*Primary Examiner*—Michael C. Wimer
*Attorney, Agent, or Firm*—Robert J. Koch

[57] ABSTRACT

Wideband antenna systems may provide continuous coverage over the VLF, HF, VHF, and UHF frequency ranges. Matching transformers, insertion resistors and damping elements are integral parts of these antenna systems.

29 Claims, 10 Drawing Sheets

BROADBAND ANTENNA

STATEMENT OF GOVERNMENT INTEREST

The U.S. Government has a paid up license in this invention and the right in limited circumstances to require the patent owner to license others on reasonable terms as provided for by the terms of contract N00019 86-C- 0285 awarded by the Naval Air Systems Command and contract N0039 88-C-0110 awarded by the Space and Naval Warfare Systems Command both under the Defense Small Business Innovation Research (SBIR) Program.

BACKGROUND OF THE INVENTION

1. Field of the Invention

This invention relates to non resonant antennas and more particularly broadband antennas. Exceptionally wide frequency bandwidth antennas may include matching a 50 ohm coaxial cable transmission line with a typical Voltage Standing Wave Ratio (VSWR) of 3:1, but may be made lower if required with a slight loss in efficiency. The invention may be used in very low frequency (VLF), high frequency (HF), very high frequency (VHF), and ultra high frequency (UHF) antenna system applications. This invention can also replace existing monopole, dipole, long wire and low/-zero profile ground or mast mounted antennas without special mechanical mounting requirements or major changes in existing antenna installations.

2. Description of the Related Technology

Radio frequency antennas may be grouped into two categories: resonant, and non-resonant/terminated. The quarter wave monopole or half-wave dipole are typical examples of resonant antennas while a rhombic antenna is an example of non resonant terminated type. In a resonant antenna, radio frequency current flows from the point the radio frequency power source connects to the antenna then goes to the opposite end of the antenna where the current flow subsequently reflects back and forth. In a non resonant terminated antenna, radio frequency current flow travels only once from the power source to a termination load at the end of the non resonant antenna. The termination load is usually a resistor equal to the impedance of the antenna viewed as a transmission line. As the radio frequency wave travels along the wire antenna element the antenna impedance undergoes a distributed rise. The resistor value is chosen such that it matches the wire distributed impedance at the point of its insertion into the wire. The effect of this is that the remaining (un radiated) forward traveling wave does not experience any further variation in impedance. Upon reflection, however, the returning wave is presented with a point impedance differing from the impedance of the wire. This reflected energy is lost partly by radiation, but more significantly, loss is due to absorption in the resistive element.

Resonant antennas are more efficient for a given length of wire but are restricted to narrow bandwidths. Non resonant antennas function over a very wide range of frequencies and the radiation pattern is more directive when the length of the antenna is multiple wavelengths of the radio frequency.

Most present day users of antennas for communication purposes desire an antenna that can operate on multiple frequencies without requiring antenna tuning or matching devices. For example, present HF antennas must operate over the typical range of from 1.5 MHz to 30 MHz. This wide frequency range requires the use of an antenna tuner which limits the useful bandwidth of the HF antenna to 10 KHz or less at the lower frequencies. This narrow bandwidth precludes the use of modern spread spectrum and frequency agile communications techniques, and causes ringing and undesirable distortion in high speed wide bandwidth data transmission. In addition, the antenna coupler, being a lossy capacitor inductor network, can result in power losses comprising a major portion of the available transmitter power at the lower frequencies.

Each time a new frequency is selected the antenna tuner must retune the entire antenna system, taking from 2 to 90 seconds to accomplish. Use of voltage tuneable networks, typically using diodes and varactors as tuning devices, have been attempted in order to decrease the tuning time. These voltage tuneable networks, however, have proven to be expensive and limited to low transmitting power. In addition, severe harmonic and intermodulation distortion results from the nonlinear radio frequency characteristics of the diode and varactor components.

Frequency agile communication techniques requiring rapid and wide frequency excursions are impossible when a tuner is required to resonate the antenna. In addition, multiple transmitters, widely spaced in frequency, cannot use a single resonant antenna because of its narrow bandwidth. Thus, simultaneous multiple transmitter operation requires multiple resonant antennas. Broadband non resonant antennas do not have these limitations.

Typically, aircraft, low/zero profile ground or mast mounted, and shipboard HF antenna installations restrict the actual length of the antenna. Typically, the maximum allowable length of a shipboard whip HF antenna is 35 feet and an aircraft wire HF antenna is 64 feet. Close proximity to metal structures or other antennas cause detuning of a resonant antenna with subsequent radiation pattern discontinuity. In addition, resonant antennas have radiation pattern nulls caused by antenna lobe pattern activity at the resonant length of the wire. Broadband HF antennas do not have as significant a problem with radiation pattern discontinuities due to close proximity to metal structures or other antennas.

It is known in the art as taught by Altshuler, "Traveling Wave Linear Antenna," IRE, Jul. 1961, that the use of a dissipative load resistor inserted in a monopole antenna will absorb the reflected wave. The load resistor is introduced at some distance from the bottom of the monopole. This distance, typically, is two thirds of the length of the antenna as measured from the feed point of the monopole. Using this type of configuration, only two thirds of the antenna height effectively radiates, the upper one third of the antenna contributes little, if any, radiation of radio frequency energy.

As the radio wave travels along the antenna the impedance undergoes a distributed rise as it does for any antenna. The insertion resistor value is chosen to match the antenna distributed impedance at the point of its connection into the radiating element. The effect of this is that the remaining (unradiated) forward traveling wave does not experience any further impedance variation. Upon reflection, however, the returning wave is presented with a point impedance differing from that of the antenna, causing additional reflection of the wave. Thus, the remaining energy is lost partly by radiation, but more significantly loss is due to absorption in the resistive insertion element.

SUMMARY OF THE INVENTION

The present invention is directed to an improved broadband HF antenna in which the entire length (height) of the antenna radiates radio frequency energy. The insertion resistor is introduced at the top of the antenna or on the inside surface of the antenna radiating element. The radio frequency antenna current travels through the insertion resistor and continues for an appreciable electrical distance in a coaxial cable and/or other passive components. Thus, the invention provides greater useable electrical radiating element length for a given physical antenna length (height).

An advantage of this invention is in the placement of the insertion resistor inside or at the top of the antenna, thus utilizing its entire length (height) for radiation of radio frequency energy. When an antenna is appreciably shorter than a quarter wavelength at the lowest operating frequency, its radiation efficiency is poor. An increase in the length (height) of the antenna radiating element will increase its efficiency at the lower operating frequencies. The present invention is an improvement over prior art broadband antennas for similar antenna length (height). The present invention has a usable bandwidth which covers the entire 1.5 MHz to 30 MHz HF frequency spectrum while maintaining a voltage standing wave ratio (VSWR) of 3:1 or less.

The present invention requires no tuning networks or couplers, thus rapid frequency hopping and spread spectrum communications techniques may be used. The present invention, because it is broadband, allows a plurality of transmitters operating at widely space frequencies to utilize just one antenna. In addition, only one broadband amplifier need be utilized with the invention for amplification of simultaneously operating transmitters. The present invention may be installed in place of existing narrow band tuned antennas without the need for a locally mounted antenna tuner system. Thus, antenna system cost, weight, spare parts, logistics of installation and reliability are improved over the prior art.

Further, the present invention may be implemented as a monopole, dipole, flat folded blanket, or long wire using single or multiple wires of the same or varying lengths. The radiating elements of the invention may be folded, flat or three dimensional using one or more wires of the same or varying lengths. The radiating elements may be flush mounted to conductive or non-conductive surfaces by, for example, conformal coating. These surfaces may be aircraft or ship structures and may enable the invention to operate more efficiently at lower frequencies with an omnidirectional radiation pattern and may be used in YAGI configurations or with reradiating surfaces to provide a conformal flush mounting antenna.

The invention may be used as a driven element/radiator in conjunction with a reflector or redirector element to achieve improved omnidirectional operation or to achieve a directional radiation pattern. The reflector or redirector elements may be similar to the broadband driven elements or may be narrow band tuned or untuned elements such as monopoles, loops or dipoles. In addition, conducting surfaces such as earth ground or sea water; or metalic surfaces, in whole or in part, such as aircraft, ships, vans, trucks, helicopters, etc. may be used as reflector elements.

The present invention was designed and developed to replace existing resonant monopole, dipole, long wire aircraft, or low/zero profile ground or mast mounted type HF antennas and associated tuning means with a broad bandwidth non resonant antenna system, thus eliminating the above problems and conditions. The present invention exhibits an extremely broad continuous bandwidth which overcomes the above mentioned problems while maintaining an effective radiated pattern with a low take-off angle, and a substantially constant voltage standing wave ratio (VSWR) over a frequency range of 1.5 to 30 MHz. In addition, the present invention design replaces existing antennas without requiring significant installation modifications.

An object of the present invention is to provide an antenna that will function over a wide range of frequencies without the need for special antenna tuners which limit the usable bandwidth thus precluding rapid frequency changes required by frequency agile communications systems.

A further object of the present invention is a constant feedpoint impedance resulting in low VSWR over a wide range of frequencies thus eliminating the requirement for antenna tuner/couplers which are generally unreliable and expensive.

A further object of the present invention is the ability to simultaneously radiate the radio frequency power from a plurality of transmitters each on different and widely spaced frequencies thus eliminating the need for multiple resonant antennas.

A further object of the invention is to greatly reduce radiation pattern breakup caused by multiple wavelength resonant antennas in proximity with metal structures.

A further object of the invention is to directly replace existing antennas without mechanical modifications or structural changes to an existing antenna installation.

DETAILED DESCRIPTION OF THE PREFERRED EMBODIMENT

Figure 1:
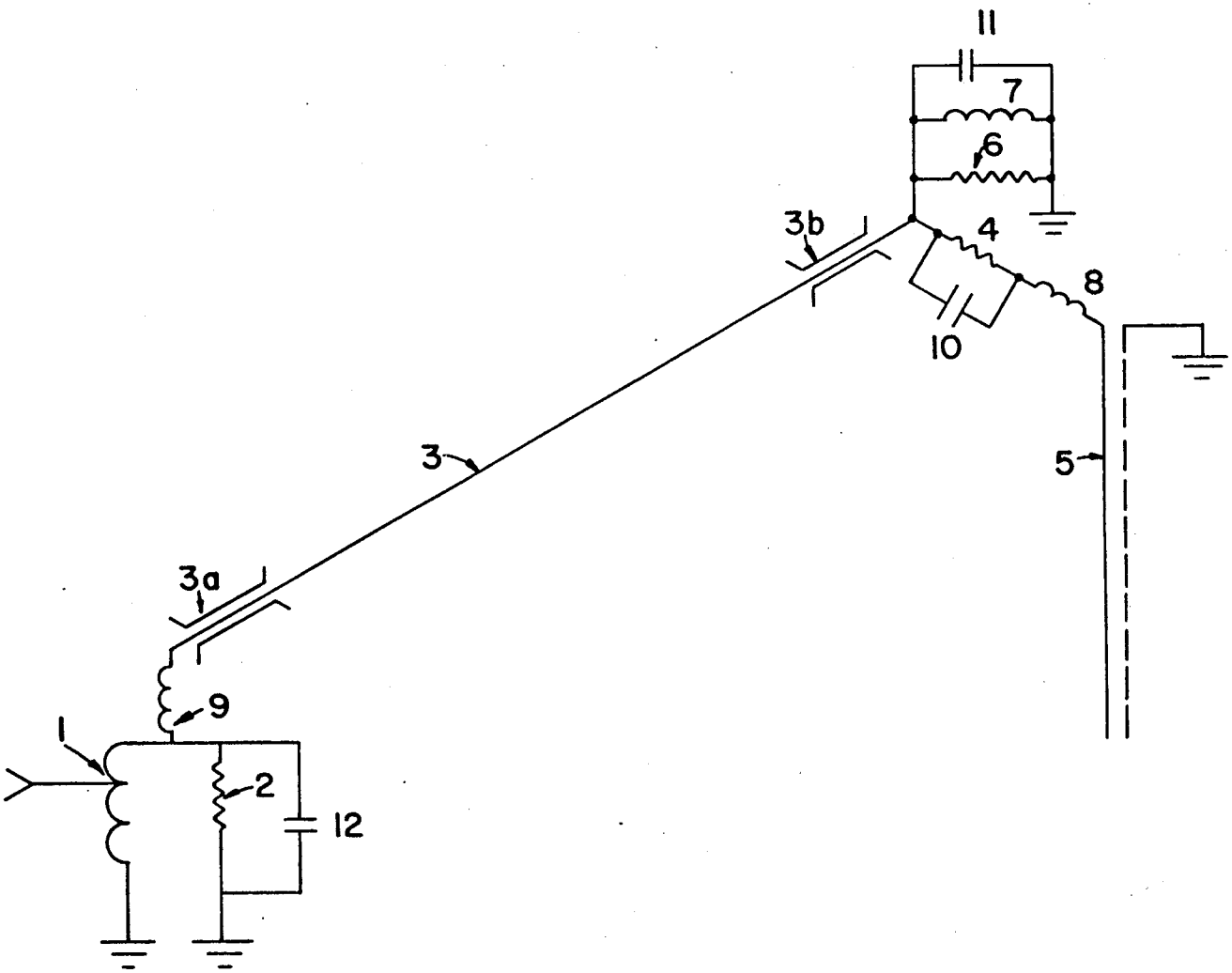
FIG. 1 is a schematic diagram of an aircraft wire antenna according to an embodiment of the present invention.

In FIG. 1 a broadband aircraft antenna system is depicted schematically. The antenna system illustrated in FIG. 1 is not limited to aircrafts. Similar installations may be used for land based and shipboard applications. The radio frequency power source(s) feed a 4:1 balun 1 which may be constructed of five turns of coaxial cable such as RG-59 with a modified outer sheath wound on a toroid core such as 4C4 material, as is well known in the art. The output of balun 1 feeds the first end of antenna wire 3 which may be stabilized by resistor 2. Resistor 2 may have a value of 1500 ohms. Use of resistor 6; inductors 7, 8, and 9; and capacitors 10, 11, and 12 are determined by the specific installation requirements to compensate for variations in different aircraft structures.

Antenna wire 3 may be approximately 20 to 64 feet long depending on the installation requirements of the aircraft and desired frequency range of operation. The second end of antenna wire 3 connects to the first end of insertion resistor 4 which may have a non inductive resistance of approximately 270 ohms. Stabilizing resistor 6, compensating capacitors 10 and 11, and compensating inductors 7 and 8 may or may not be needed depending on the aircraft type and construction of the fuselage. Resistor 6 may have a value of 1500 ohms. 30 Connected to the second end of insertion resistor 4 is damping element 5 which may comprise about 18 feet of coaxial cable such as RG-58. This configuration of coaxial cable gives the long wire its extra electrical length and allows the damping insertion resistor to be placed within the aircraft structure. The prior art would have placed the damping load resistor at typically two thirds of the way along the length of the antenna wire as taught by Altshuler.

Feed through bushings 3*a* and 3*b* allow antenna wire 3 to be externally mounted on an aircraft while balun 1, stabilizing resistors 2 and 6, insertion resistor 4, damping element 5, compensation inductors 7, 8 and 9, and compensation capacitors 10, 11 and 12 may be internally mounted within the aircraft structure so as not to affect the aerodynamics of the airplane. Thus, this embodiment may directly replace existing tuned wire antennas used on aircraft. Minor internal modification, if any, may be required of the aircraft for the installation of the present invention's internal parts.

Insertion resistor 4 may have a power rating of approximately half the output power of the transmitters feeding the antenna system. The purpose of insertion resistor 4 is to absorb and dissipate reflected antenna currents. An additional feature of the insertion resistor is to match the characteristic impedance of the antenna at its point of insertion, thus allowing a low VSWR over a wide frequency range.

Figure 4:
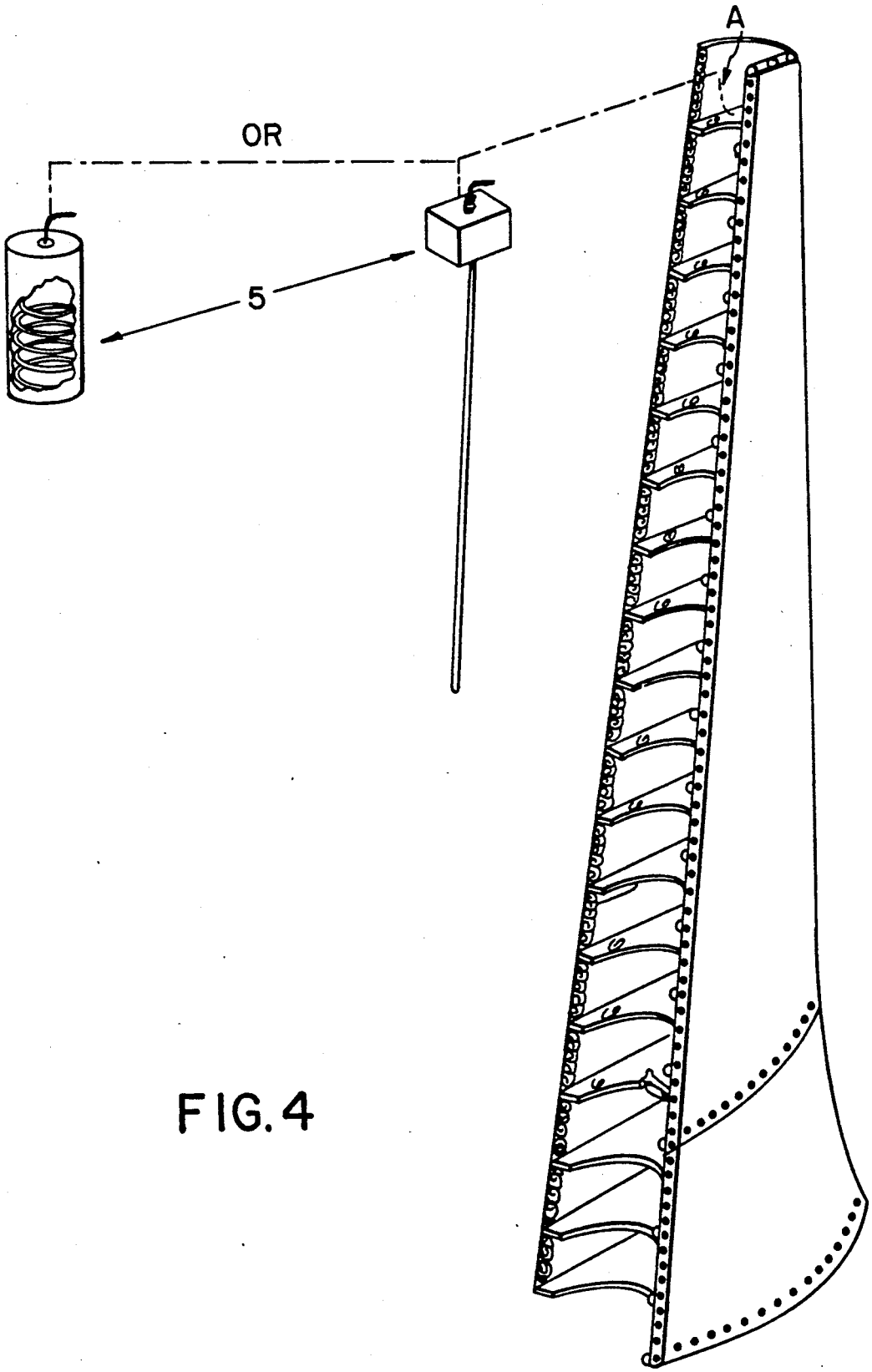
FIG. 4 is a view of alternate mechanical configurations for a linear capacitive damping element mounted in an aircraft rear vertical or horizontal stabilizer according to an embodiment of the present invention.

Damping element 5 may be a linear capacitor comprising approximately 18 feet of coaxial cable which may be non-inductive at the operating frequencies of interest. At some of the operating frequencies the coaxial cable may act as a short circuit, at other frequencies as an open circuit. Thus, when the coaxial cable, as the damping element 5, is used in conjunction with the insertion resistor and radiating element, it may provide improved and extended operation over a wide range of frequencies. The purpose of the damping element 5 is to provide continuity to the radiator wire element 3 and to provide a frequency variable capacitive loss after the insertion resistor 4. Thus damping element 5 serves as an artificial ground return. As illustrated in FIG. 4, the damping element 5 may be tightly coiled and placed within a protective box or may be left substantially straight and clamped to the internal superstructure of the airplane's vertical or horizontal stabilizer.

Figure 2:
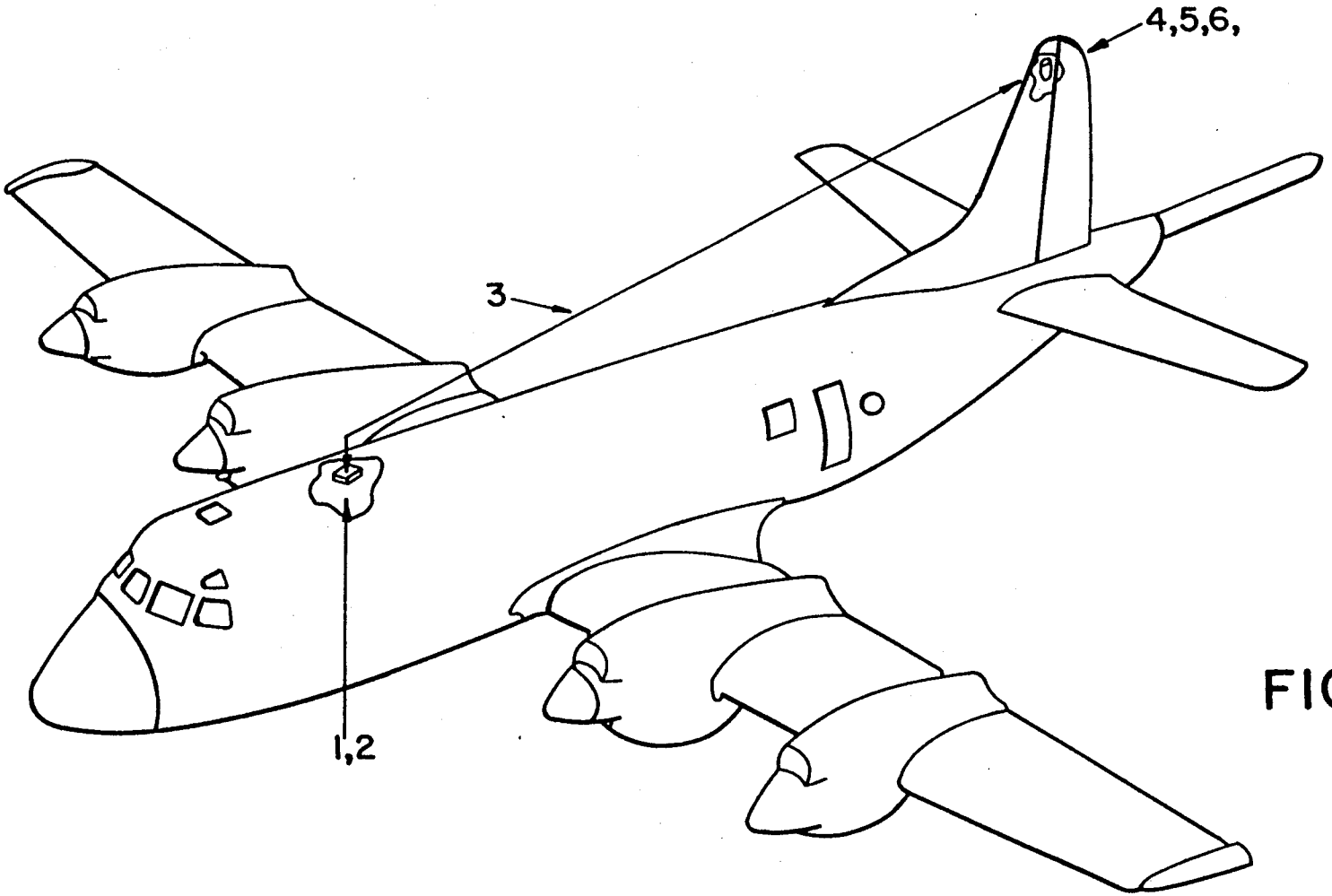
FIG. 2 is a side elevational view of an aircraft antenna wire running from the top front of an aircraft to the upper part of the rear vertical stabilizer according to an embodiment of the present invention.
Figure 3:
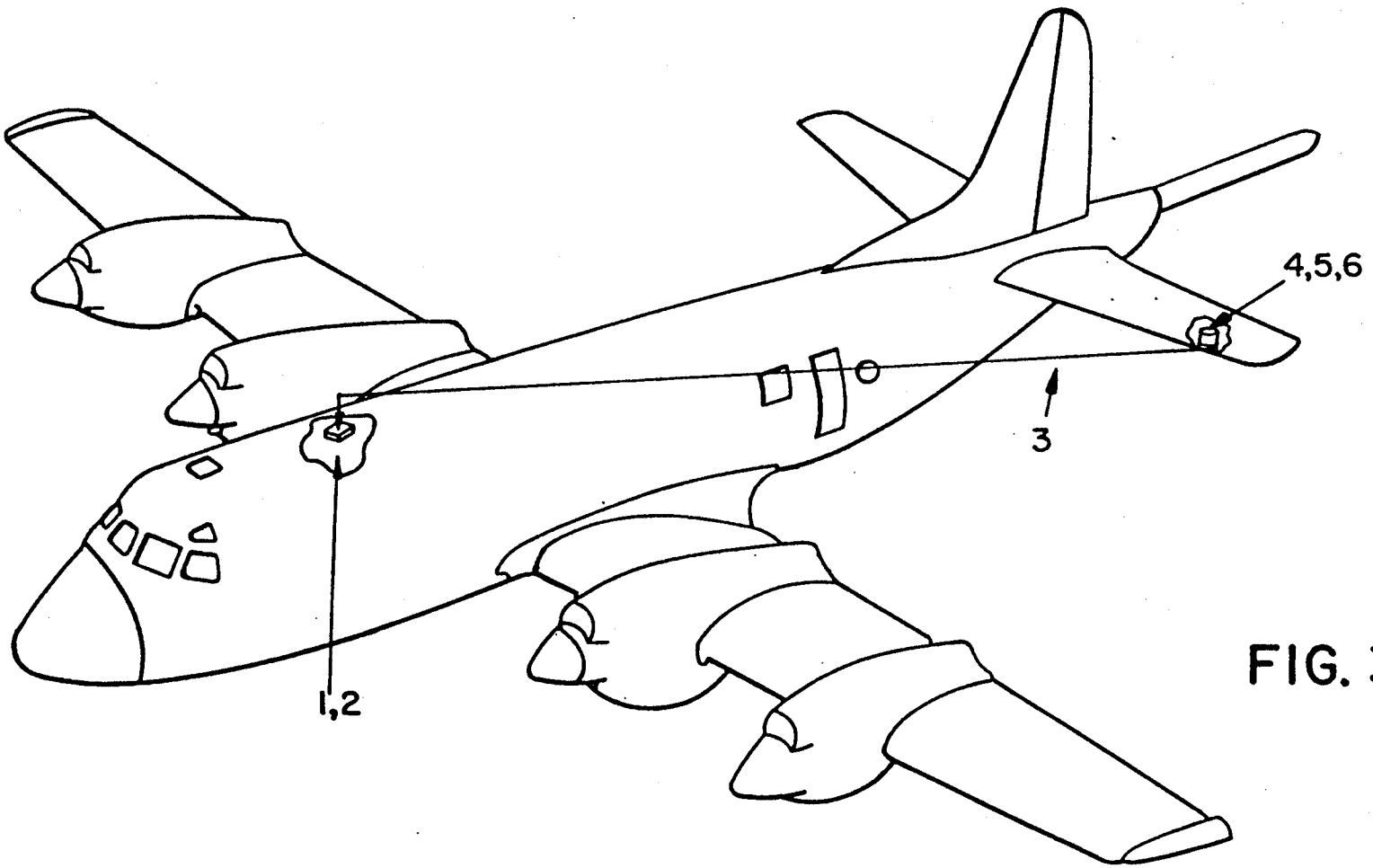
FIG. 3 is a top view of an aircraft with an antenna wire running from the top front of the aircraft to one of the rear horizontal stabilizers according to an embodiment of the present invention.

As illustrated in FIGS. 2 and 3, the antenna wire 3 may be run from the top front of the aircraft to either the tip of the vertical stabilizer or one of the horizontal stabilizers. The structure of either stabilizer is the same internally. Insertion resistor 4, stabilizing resistor 6 and damping element 5 may be physically small and mounted in any fashion within the aircraft structure.

A significant factor in the present invention is the ability to preserve a constant feed point impedance and thus a constant VSWR over a wide frequency range without the need for expensive and unreliable antenna tuners. This constant impedance/VSWR independent of operating frequency allows the present invention to be used by a plurality of transmitters simultaneously while operating on widely spaced frequencies. In addition, the new technique of spread spectrum communications which reduces the possibility of interference and jamming, but requires frequency agile transmitters, receivers, and antennas operable over a wide frequency range. This wide frequency range is necessary because of the spread spectrum requirement of rapid and wide frequency hopping.

The aircraft antenna system of this invention has three main parts: a terminated non-resonant wire element, a matching balun transformer to improve the antenna impedance characteristics to a 50 ohm coaxial transmission line, and a damping element to maintain the continuity of the antenna system without the necessity of a ground return system.

Figure 5:
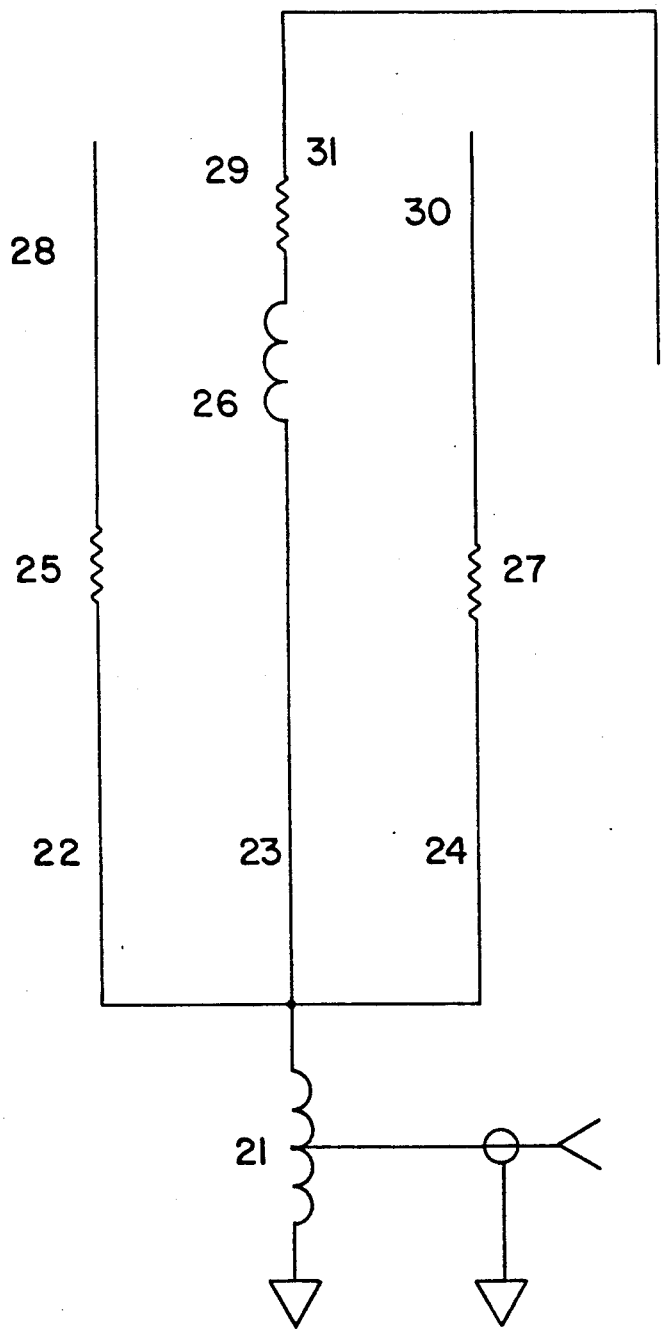
FIG. 5 is a schematic diagram of a monopole antenna according to an embodiment of the present invention.

FIG. 5 is a schematic diagram of a broadband antenna system which can replace both dipole and monopole resonant antennas used on board ships, motor vehicles, or any type of temporary or permanent land based radio communications installation. In the embodiment illustrated in FIG. 5, the radio frequency power source (transmitters) feed a balun 21 which improves the impedance matching characteristics of the antenna to the transmitters, as is well known in the art.

Connected to the output of balun 21 are first ends of wire elements 22, 23 and 24. These wire elements may be mostly straight, bent, folded or helically wound depending on the frequency to physical length characteristics desired. Insertion resistors 25, 27, and 29 are each connected to an associated end of wire elements 22, 23 and 24. These insertion resistors are used to absorb the reflected travelling wave. Depending on the frequency of operation, inductor 26 may be used to automatically disconnect insertion resistor 29 from the antenna system. At the lower frequencies of operation, the impedance of inductor 26 is small in comparison to the combined impedance of insertion resistor 29 and wire element 31. At the higher frequencies, the impedance of inductor 26 becomes greater than the combined impedance of insertion resistor 29 and wire element 31. Thus, inductor 26 effectively disconnects insertion resistor 29 and wire element 31 from wire element 23. Capacitors or combinations of capacitors and inductors may also be used to automatically connect or disconnect different insertion resistors depending on the operating frequency range. Wire elements 28, 30, and 31 function as damping means and may be mostly straight, bent, folded or helically wound.

Figure 6:
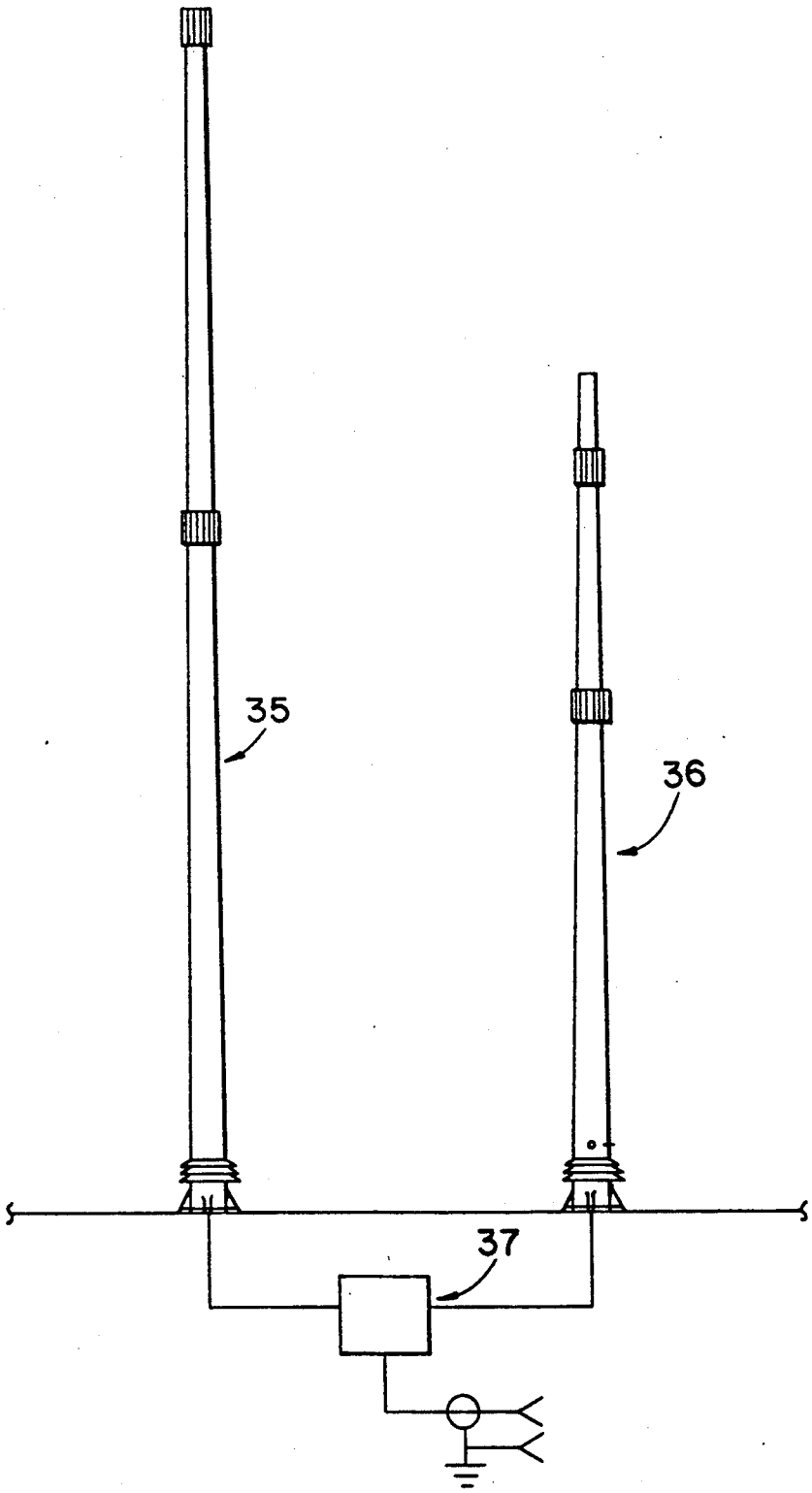
FIG. 6 is a side elevational view of a shipboard monopole antenna system according to an embodiment of the present invention.
Figure 6A:
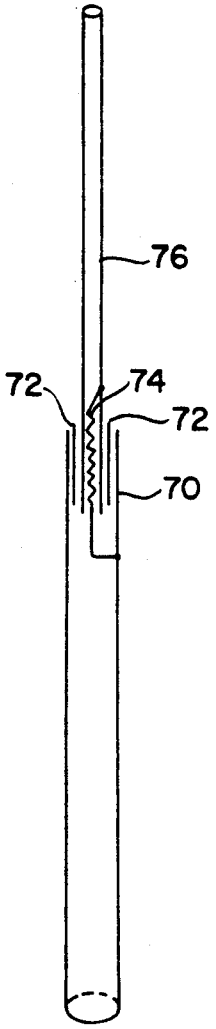
FIGS. 6*a* and 6*b* are schematic diagrams of a monopole antenna illustrating the insertion resistor and damping element mounting according to embodiments of the present invention.
Figure 6B:
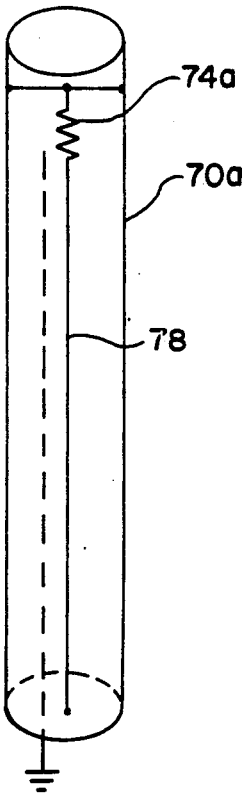

Another embodiment of the present invention is illustrated in FIG. 6 which depicts a combination of a first monopole 35 with a second monopole 36. The first monopole 35 may be 35 feet and the second monopole 36 may be 25 feet in length. This embodiment gives equivalent or better performance than a conventional tuned resonant 35 foot monopole. The broadband antenna system, illustrated in FIG. 6, may be comprised of, for example, two cylindrical vertical self supporting fiberglass structures enclosing a combination of wire radiating elements 22, 23 and 24; insertion resistors 25, 27 and 29; switching element 26 and damping elements 28, 30 and 31 as depicted in FIG. 5. The vertical monopoles of FIG. 6 may use a matching balun and power splitter 37 to improve impedance matching to the transmitter(s) and allow one coaxial cable to feed power to this embodiment, as is well known in the art. The insertion resistors 74 may be mounted internally in the radiating elements 70, as illustrated in FIGS. 6*a* and 6*b*. The damping element 76 may extend above the radiating element 70, as illustrated in FIG. 6*a*, and be attached to the radiator 70 by an insulator 72. Another embodiment, as illustrated in FIG. 6*b*, has the damping element 76 located inside of the radiator 70, where the internal damping element 76 may be a coaxial cable similar to the damping element 5, illustrated in FIG. 1.

Figure 7:
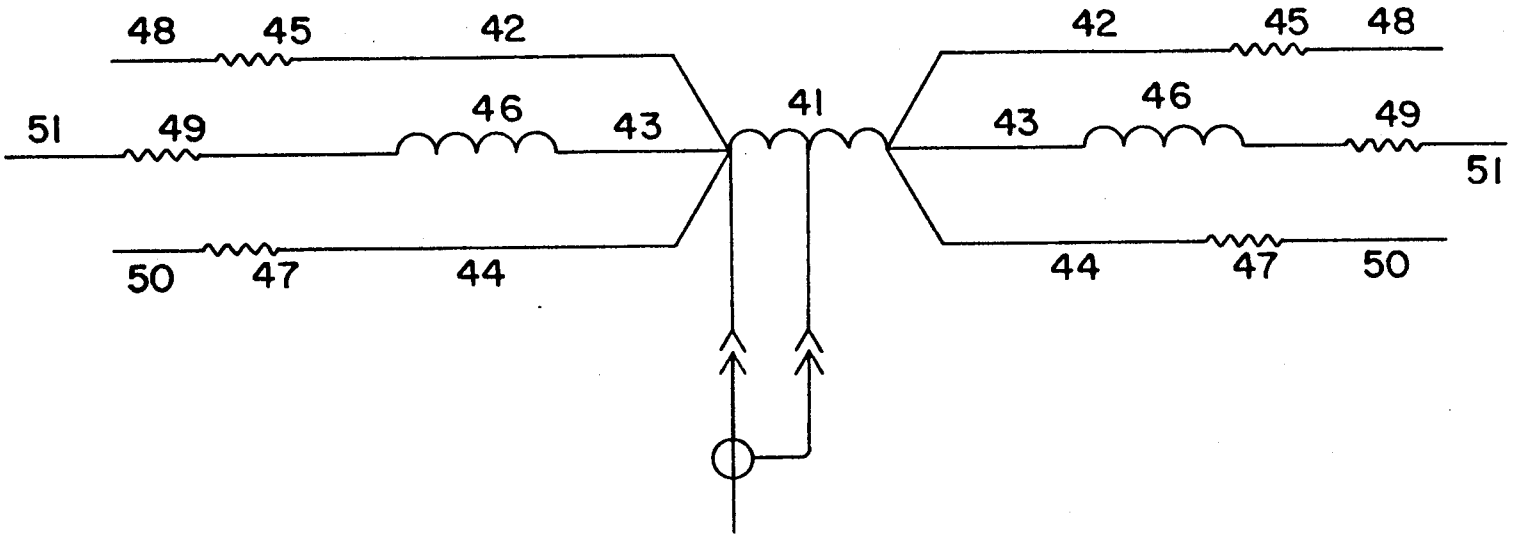
FIG. 7 is a schematic diagram of a ground independent balanced broadband antenna according to an embodiment of the present invention.

Yet another embodiment of the present invention, illustrated in FIG. 7, is a broadband antenna system which can replace both dipole and long wire resonant antennas used on board ships or any type of temporary or permanent land based radio communications installation. This embodiment is physically similar in appearance and mounting requirements to a resonant dipole antenna. However, the antenna depicted schematically in FIG. 7 is not limited to the narrow frequency range of a resonant dipole antenna. This embodiment does not require a ground system nor does it require any type of matching network or tuner for use over a wide range of frequencies, typically from 1.5 MHz to 88 MHz. An embodiment of the antenna illustrated in FIG. 7 may use individual elements or combinations of the elements as depicted.

Balun 41 connects a coaxial cable directly to this balanced ground independent antenna. In addition, balun 41 may improve the impedance match between the balanced characteristics of the antenna and the unbalance coaxial cable feeding power from the transmitter, as is well known in the art.

Figure 7A:
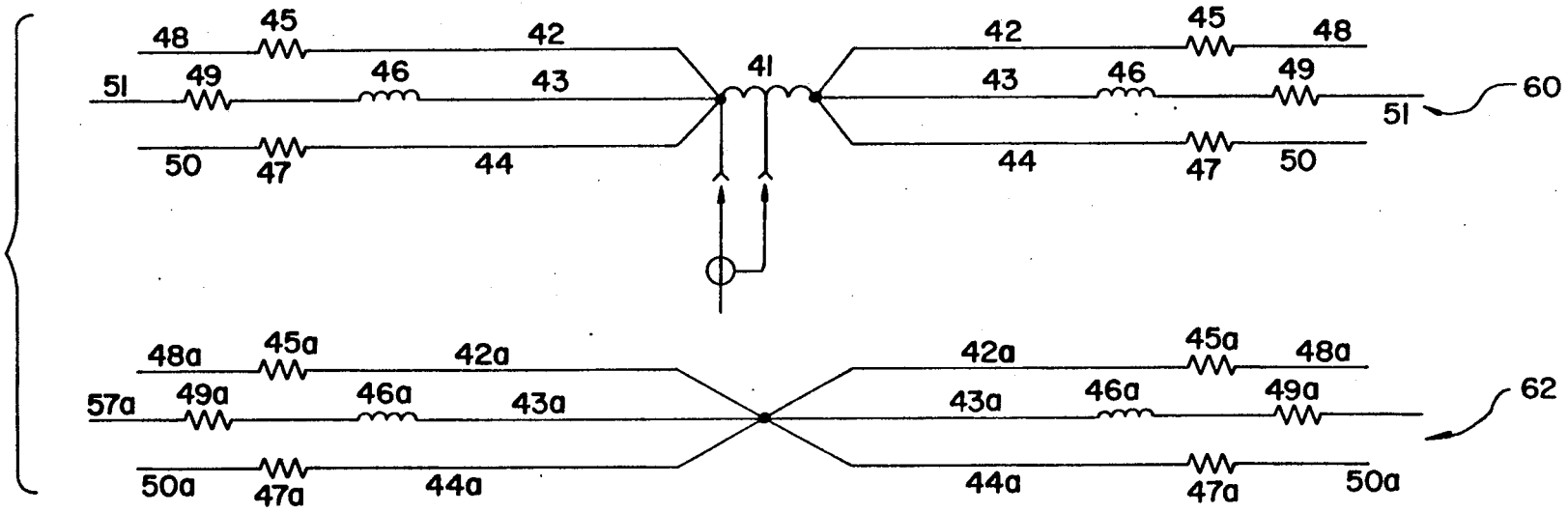
FIG. 7*a* is a schematic diagram of a ground independent balanced broadband antenna having a reflector or redirector according to an embodiment of the present invention.

As illustrated in FIG. 7, wire elements 42, 43 and 44 may be mostly straight, bent, folded or helically wound depending on the frequency to physical length characteristics desired. Insertion resistors 45, 47, and 49 may be used to absorb the reflected travelling wave. Depending on the frequency of operation, inductor 46 may be used to automatically disconnect insertion resistor 49 from the antenna system. At the lower frequencies of operation, the impedance of inductor 46 is small in comparison to the combined impedance of insertion resistor 49 and wire element 51. At the higher frequencies, the impedance of inductor 46 becomes greater than the combined impedance of insertion resistor 49 and wire element 51. Thus, inductor 46 effectively disconnects insertion resistor 49 and wire element 51 from wire element 43. Capacitors or combinations of capacitors and inductors may also be used to automatically connect or disconnect different insertion resistors depending on the operating frequency range. Wire elements 48, 50 , and 51 function as damping means and may be mostly straight, bent, folded or helically wound. As illustrated in FIG. 7*a*, another embodiment of the invention may be used to achieve an unidirectional radiation pattern by having a driven element 60 and either a reflector or redirector element 62 comprising a directive antenna. All of the respective parts of the driven element 60 may be utilized in the reflector or redirector 62 as represented by suffix "a" after each corresponding element number. Thus, FIG. 7 illustrates a dipole capable of a bidirectional radiation pattern in the horizontal plane and FIG. 7*a* illustrates a directive antenna with a unidirectional radiation pattern.

Figure 8:
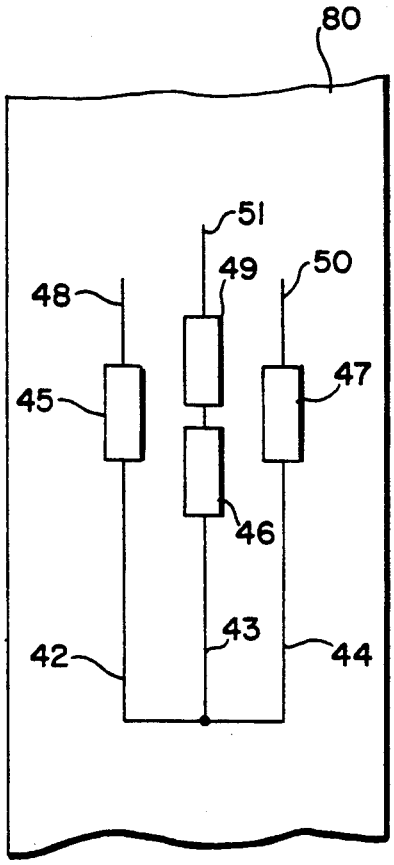
FIG. 8 is an elevational view of an antenna conformally coated to a surface according to an embodiment of the present invention.

A s illustrated in FIG. 8, elements 42–51 may be conformally coated on the surface of a structure 80. The structure 80 may be metallic or non-metallic or a combination thereof. A typical structure may be the fuselage or wing of an airplane, or the superstructure of a naval vessel.

One skilled in the art will readily appreciate that the present invention is well adapted to carry out the objectives and attain the ends and advantages mentioned, as well as, those inherent therein. The structures and techniques described herein and depicted in the accompanying drawings are presently representative of the preferred embodiments, are intended to be exemplary, and are not intended al limitations on the scope of this invention. Changes therein and other uses will occur to those skilled in the art which are encompassed within the spirit of the invention or defined by the scope of the appended claims.

What is claimed is:

1. A wideband antenna system for continuous coverage of the 1.5 MHz to 30 MHz radio frequency spectrum which is coaxial cable fed and having low VSWR, comprising:

a coaxially fed wideband balun having a low impedance input and a high impedance output;

at least one wire radiating element, said element having a first and second end, said first end connected to said wideband balun high impedance output;

at lest one insertion resistor, said resistor having a first and second end, wherein said insertion resistor first end is connected to said radiating element second end; and at least one radio frequency damping element, said damping element connected to the second end of said insertion resistor;

at least one first stabilizing resistor connected to said wire radiating element first end; and at least one second stabilizing resistor connected to said wire radiating element second end.

2. An antenna system according to claim 1, wherein said wideband balun has an input impedance of 50 ohms and an output impedance of 200 ohms.

3. An antenna system according to claim 1, wherein said wire radiating element is helically wound.

4. An antenna system according to claim 1, wherein said wire radiating element is folded.

5. An antenna system according to claim 1, wherein said wire radiating element is from 20 to 64 feet in length.

6. An antenna system according to claim 1, wherein said insertion resistor is 270 ohms.

7. An antenna system according to claim 1, wherein said damping element is a coaxial cable linear capacitor.

8. An antenna system according to claim 7, wherein said coaxial cable linear capacitor is 18 feet in length.

9. An antenna system according to claim 1, wherein said damping element is a wire.

10. An antenna system according to claim 9, wherein said wire is from 9 to 11 feet in length.

11. An antenna system according to claim 1, further comprising:

a passive switching element connected between said insertion resistor and said radiating element.

12. An antenna system according to claim 11, wherein said passive switching element is an inductor.

13. An antenna system according to claim 11, wherein said passive switching element is a capacitor.

14. An antenna system according to claim 11, wherein said passive switching element is a combination of capacitors and inductors.

15. An antenna system according to claim 1, further comprising:

a radio frequency compensation means connected between said wire radiating element and said balun output, for adjusting antenna system characteristics and correcting for close proximity metal structures and associated ground currents.

16. An antenna system according to claim 1, further comprising:

a radio frequency compensation means connected between said wire radiating element and said insertion resistor configured to adjust the characteristics of the antenna system and correcting for close proximity metal structures.

17. An antenna system according to claim 15, wherein said radio frequency compensation means comprises a capacitor.

18. An antenna system according to claim 1, wherein the first and second stabilizing resistors are nominally 1500 ohms.

19. An antenna system as recited in claim 1, further comprising:

at least one cylindrical vertical self supporting structure, transparent to radio waves, enclosing said wire radiating element, insertion resistor and damping element.

20. An antenna system as recited in claim 1, wherein said wire radiating element is externally mountable, and said wideband balun, insertion resistor and damping element are internally mountable in an aircraft structure.

21. An antenna system as recited in claim 1, wherein a watertight structure, transparent to radio waves, encloses said wire radiating element, balun, insertion resistor and damping element.

22. An antenna system according to claim 1, wherein said wire radiating element is conformably coated to a structure.

23. An antenna system according to claim 22 wherein said structure is metallic.

24. An antenna system according to claim 1, wherein said antenna system is coupled to reflector elements.

25. An antenna system according to claim 1, wherein said antenna system is coupled to redirector elements.

26. An antenna system according to claim 1, wherein said insertion resistor is mounted inside said radiating element.

27. A wideband antenna system for continuous coverage of the 1.5 MHz to 30 MHz radio frequency spectrum which is coaxial cable fed and having low VSWR, comprising:

a coaxially fed wideband balun having a low impedance input and a high impedance output;

at least one wire radiating element, said element having a first and second end, said first end connected to said wideband balun high impedance output;

at least one passive switching means, said switching means having a first and second end, wherein said passive switching means first end is connected to the second end of said radiating element;

at least one insertion resistor, said insertion resistor having a first and second end, wherein said insertion resistor first end is connected to the second end of said passive switching means; and at least one radio frequency damping element, said damping element connected to the second end of said insertion resistor.

28. A wideband ground independent balanced antenna system for continuous coverage of the 1.5 MHz to 30 MHz radio frequency spectrum which is coaxial cable fed and having low VSWR, comprising:

a coaxially fed wideband balun having a low impedance input and a high impedance balanced output;

at least two wire radiating elements, each having a first and second end, said first ends connected to the wideband balun high impedance output;

at least two passive switching means, each having a first and second end, wherein said passive switching means first end is connected to a radiating element second end;

at least two insertion resistors, each having a first and second end, wherein said insertion resistor first end is connected to a passive switching means second end; and at least two radio frequency damping elements each connected to a second end of an insertion resistor, wherein each wire element is connected to a passive switching means, each passive switching means is connected to an insertion resistor, and each insertion resistor is connected to a damping element.

29. An antenna system according to claim 28, further comprising:

a passive switching element connected between said insertion resistors and said radiating elements.

* * * * *